US007183991B2

(12) United States Patent
Bhattacharyya et al.

(10) Patent No.: US 7,183,991 B2
(45) Date of Patent: Feb. 27, 2007

(54) MULTIPLE FLARED ANTENNA HORN WITH ENHANCED APERTURE EFFICIENCY

(75) Inventors: Arun K. Bhattacharyya, El Segundo, CA (US); James Sor, Los Angeles, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 11/003,901

(22) Filed: Dec. 3, 2004

(65) Prior Publication Data

US 2006/0119528 A1 Jun. 8, 2006

(51) Int. Cl.
*H01Q 13/00* (2006.01)

(52) U.S. Cl. ..... 343/786; 343/772

(58) Field of Classification Search ..... 343/786, 343/772, 783
See application file for complete search history.

(56) References Cited

U.S. PATENT DOCUMENTS 3,662,393 A * 5/1972 Cohn ..... 343/786
3,745,291 A 7/1973 Peterson et al.
3,831,548 A 8/1974 Droege
3,935,577 A 1/1976 Hansen
3,990,081 A 11/1976 Guennou
4,329,905 A 5/1982 Lloyd
4,348,549 A 9/1982 Berlant
4,357,612 A 11/1982 Salvat
4,488,156 A 12/1984 DuFort
4,507,660 A 3/1985 Hemming
4,731,616 A * 3/1988 Fulton et al. ..... 343/786
4,757,324 A 7/1988 Dhanjal
4,792,814 A * 12/1988 Ebisui ..... 343/786
4,847,574 A 7/1989 Gauthier
4,878,061 A 10/1989 Nusair
4,975,965 A 12/1990 Adamson
5,626,568 A 5/1997 Yeh
5,868,722 A 2/1999 Yeh
5,931,072 A 8/1999 Shibata
5,973,653 A 10/1999 Kragalott
6,137,450 A * 10/2000 Bhattacharyya et al. .... 343/786
6,368,309 B1 4/2002 Yeh
6,384,795 B1 * 5/2002 Bhattacharyya et al. .... 343/786
6,394,875 B1 5/2002 Smith
6,589,097 B2 7/2003 Smith
6,642,900 B2 * 11/2003 Bhattacharyya et al. .... 343/786

* cited by examiner

*Primary Examiner*—Hoanganh Le
(74) *Attorney, Agent, or Firm*—Carmen B. Patti & Assoc., LLC

(57) ABSTRACT

An antenna horn having multiple flared sections with their slopes and lengths selected to enhance desirable electromagnetic modes and to suppress undesirable modes at the horn aperture, thereby increasing the aperture efficiency and antenna gain.

20 Claims, 3 Drawing Sheets

MULTIPLE FLARED ANTENNA HORN WITH ENHANCED APERTURE EFFICIENCY

GOVERNMENT RIGHTS

This invention was made with Government support under contract number F04701-02-C-0002 awarded by the Department of the Air Force. The Government has certain rights in this invention.

BACKGROUND OF THE INVENTION

This invention relates generally to antenna horns and, more particularly, to antenna horns having multiple sections. Horn antennas are widely used in microwave communication systems. Basically a horn antenna is a flared structure that provides coupling between free space and a waveguide used to carry microwave signals, either received from the antenna or to be transmitted to the antenna. Although some microwave energy could be radiated from or received in an open-ended waveguide, flaring the open end of the waveguide results in better impedance matching between the waveguide and free-space. This flared horn antenna structure provides more efficient coupling both in transmit and receive modes. The efficiency of antenna horns is particularly important in the design of phased arrays of multiple antenna elements, each with its own antenna horn.

The gain of an antenna array is dependent on two factors: the element gain (which depends on the element aperture efficiency) and the number of elements in the array. To satisfy an overall array gain requirement it is desirable that the element aperture efficiency be as high as possible. Using a high efficiency antenna element would allow the number of radiating elements needed in the array to be reduced, thus reducing the array's overall size and weight. More importantly, for an active array the number of active circuit modules, such as solid-state power amplifiers, phase-shifters and band-pass filters, is also reduced by the use of high efficiency antenna elements. These circuit modules constitute the most expensive parts of a phased array system, and minimizing the number of modules results in a significant cost savings. For instance, a 10% aperture efficiency improvement in each radiating element allows the use of 10% fewer elements, which in turns reduces array component costs by 10%. Accordingly, there always exists a need for an antenna horn with improved aperture efficiency. The antenna element gain can be increased by simply increasing the aperture size, because the antenna gain is proportional to the area of the aperture. This is not, however, a practical approach in the design of antenna array. Increasing the aperture area results in increased weight and cost of the array.

It is well known that the presence of a particular set of TE (transverse electric) modes with proper amplitude and phase yields a uniform aperture distribution, resulting in a high aperture efficiency. Prior to the present invention, attempts to improve aperture efficiency by the use of a stepped horn profile have suffered from high fabrication costs and limited bandwidth. Thus, there is still a significant need for a new approach to antenna horn design that increases aperture efficiency over a wider bandwidth to allow for fewer antenna elements in an array. The present invention satisfies this need.

SUMMARY OF THE INVENTION

The present invention resides in an antenna horn element that exhibits very high aperture efficiency (typically over 90%). The horn structure of the invention is comprised of multiple flared sections, without any step discontinuities, which makes the horn structure very attractive from a manufacturing point of view. Briefly, and in general terms, the antenna horn of the invention comprises at least three contiguous flared horn sections. A first of the flared horn sections is adapted to be coupled to a waveguide and the last of the flared horn sections has an aperture through which electromagnetic energy is coupled to or from space. The slopes and lengths of the flared horn sections are selected to enhance desirable electromagnetic modes at the aperture, thereby enhancing the aperture efficiency and antenna gain.

A disclosed embodiment of the antenna horn has four flared horn sections, although it will be appreciated that other numbers of sections may be used in accordance with the principles of the invention. The disclosed embodiment is an antenna horn of circular cross section, but the invention also applies to horns of rectangular and other cross sections.

In the disclosed embodiment of the invention, the desirable electromagnetic modes are TE modes and the flared horn sections are selected to enhance the TE modes and suppress any TM (transverse magnetic) modes at the aperture. Adjacent flared horn sections of the invention have slope discontinuities between them, but no step discontinuities. The lack of step discontinuities facilitates manufacture of the horn. Other aspects and advantages of the invention will become apparent from the following more detailed description, taken in conjunction with the accompanying drawings.

DETAILED DESCRIPTION OF THE INVENTION

Figure 1:
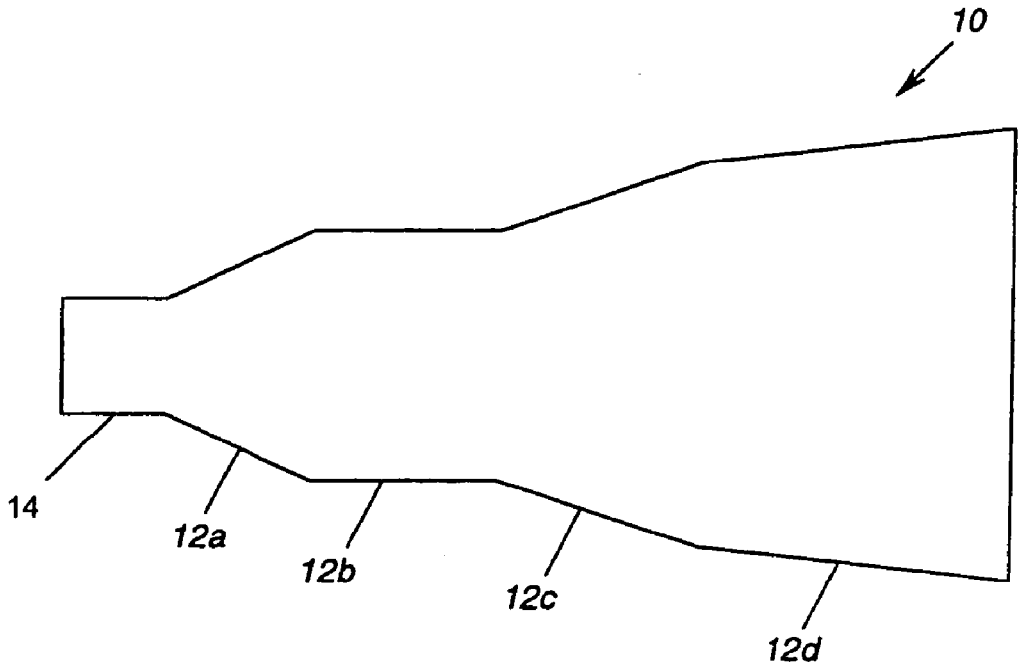
FIG. 1 is a simplified view of an antenna horn cross-sectional profile in accordance with the present invention.

As shown in the drawings for purposes of illustration, the present invention is concerned with antenna horns and with techniques for improving the efficiency of antenna horns. The gain of an antenna is given by the expression:

$$G = \frac{4\pi\eta A}{\lambda^2},$$

where G is the antenna gain, $\eta$ is the aperture efficiency, A is the physical area of the aperture, and $\lambda$ is the wavelength. Thus the antenna gain is directly proportional to the aperture efficiency.

In many applications, but particularly in the case of phased array antennas, it is highly desirable to provide an elemental antenna with an aperture efficiency as high as possible, because doing so increases the elemental gain and reduces the number of elements needed to form an array with a required overall gain. The present invention provides a new approach to improving the aperture efficiency of an antenna horn.

In accordance with the invention, an antenna horn includes multiple flared sections with flare angles and lengths selected to optimize the generation of electromagnetic modes known to be needed to increase antenna horn efficiency, and to minimize the presence of modes known to be detrimental to antenna horn efficiency. Electromagnetic propagation in a waveguide may be analyzed and defined in terms of multiple electromagnetic waves or modes. Maxwell's equations describe electro-magnetic waves or modes as having electric field components and magnetic field components. In the mode field patterns for transverse electric (TE) modes, the electric field is perpendicular to the direction of propagation.

For a circularly symmetrical waveguide, the dominant mode is designated the $TE_{1,1}$ mode, where the subscript "1,1" indicates the mode order. For circular waveguides, the first subscript indicates the number of full-wave patterns around the circumference of the waveguide. If one were to measure the electric field pattern at various points spaced circumferentially around the waveguide, the measured electric field lines could be seen to vary from zero through a positive maximum, back to zero, through a negative maximum and back to zero again. In other words there is one full cycle of variation of the electric field. The second subscript indicates the number of half-wave patterns across the diameter of the waveguide. When the electric field variation along the diameter of the waveguide is considered, it can be seen to vary from zero at the extremities to a maximum at the center. In other words there is one half-cycle of variation and the second subscript is also 1. $TE_{1,1}$ is, therefore, the complete mode description of the dominant mode in circular waveguides.

Other TE modes are, of course, possible in a practical circular waveguide and various transverse magnetic (TM) modes may also occur. In a TM mode, the entire magnetic field associated with the propagating wave lies in the transverse plane, and no component of the magnetic field is parallel to the propagation direction. Somewhat different considerations apply to rectangular waveguides and the mode order subscripts are defined differently.

The principal function of an antenna horn is to couple to free space an electromagnetic wave propagating in a waveguide. An equivalent function is, of course, performed in coupling free-space radiation back into the waveguide. For convenience, this description will refer to the function of the antenna horn in the transmit mode. It will be understood, however, that the horn performs an equivalent function when acting in the receive mode.

If a circular waveguide is used to transmit directly to space, without the benefit of an antenna horn, energy leaving the waveguide will be predominantly in the $TE_{1,1}$ mode. In this mode, as discussed above, the electric field energy is at a peak at the waveguide center, and tapers off toward the waveguide circumference. It is well understood that the electromagnetic energy will be most efficiently coupled to space if the electric field energy is more uniformly distributed across the waveguide aperture. In essence, this is the function performed by the horn. The flared profile of an antenna horn results in the generation of additional TE modes, which, together with the $TE_{1,1}$ mode, result in a composite electric field distribution that is conducive to more efficient coupling of the energy from the waveguide into space. The antenna horn may also produce additional TM modes, which, in general, do not contribute to efficient energy coupling.

More specifically, it is well known that, for a horn radiator, a particular set of TE modes with proper amplitude and phase yields the desired uniform aperture distribution, and hence high aperture efficiency may be achieved. The structure of the present invention generates the required set of modes by changing the horn flare angles. A change in the flare angle changes the phase and amplitude taper along the radial direction, creating multiple waveguide modes. "Slope discontinuities" at appropriate locations allow the desired modes to propagate toward the horn aperture. The slope of each horn section and the distance between them are adjusted in order to have the desired modes arriving at the aperture with appropriate amplitudes and phases.

As shown in FIG. 1, an antenna horn 10 in accordance with the present invention consists of multiple linearly flared sections. FIG. 1 shows a typical horn geometry with four flares, indicated at 12*a*, 12*b*, 12*c* and 12*d*, respectively. The smaller input section 14 is for connection to a waveguide. In this description, the horn 10 is assumed to be comprised of cylindrical and conical sections, but the principles of the invention also apply to rectangular waveguides. A larger number of flares may, of course, be used for a larger aperture size, and in some applications a smaller number, such as three, may be sufficient to provide a desired aperture efficiency.

The dominant mode (TE-11 mode for circular geometry) is launched at the horn input 14. As the dominant mode propagates through the first conical section 12*a*, it is slowly modified to a more spherical wave-front. A spherical wave-front is associated with multiple waveguide modes. Thus, multiple modes are produced by the first flared section 12*a*. This process is repeated in every flared section. By adjusting the lengths of the flared sections, the undesired modes are phase-cancelled and the desired modes are constructively intensified.

Table 1 shows the modal content of energy radiated from the aperture of the horn 10 as compared with that of a conical horn of similar size. Each mode represented is indicated by its relative amplitude and its phase.

TABLE 1

| Horn Type | Appr. Effcy. | $TE_{1,1}$ | $TM_{1,1}$ | $TE_{2,1}$ | $TM_{2,1}$ | $TE_{3,1}$ | $TM_{3,1}$ |
|---|---|---|---|---|---|---|---|
| Conical | 75% | 1.0; 0° | .30; 88° | .15; −89° | .08; 50° | .04; −118° | .02; 34° |
| Invented | 93% | 1.0; 0° | .04; 118° | .23; 0.5° | .06; −53° | .06; −69° | .007; 72° |

Figure 2:
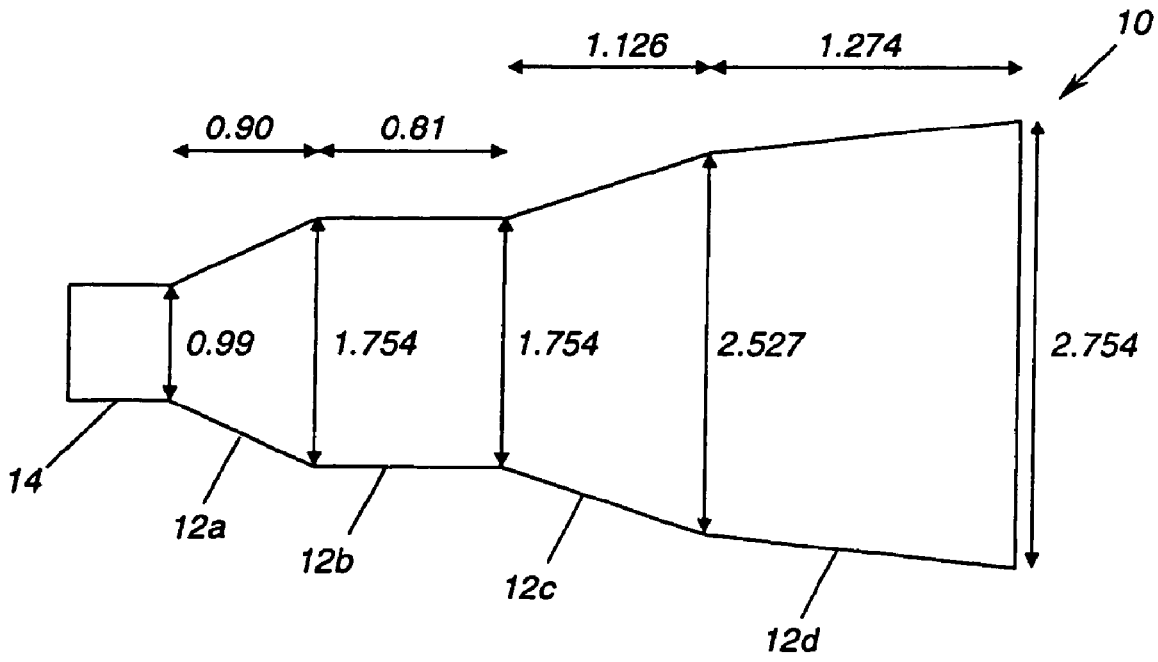
FIG. 2 is a profile of the antenna horn of the invention similar to FIG. 1, including exemplary dimensional relationships in terms of wavelengths.

It will be observed from Table 1 that the horn aperture in the structure of the invention is dominated by the TE modes as required for high efficiency performance. The TM modes at the aperture have been significantly reduced in comparison with the conventional conical antenna horn. In particular, the $TM_{1,1}$ is reduced by a factor of about seven. Moreover, the higher-order TE modes have been increased in magnitude. The net result is that the aperture efficiency has been increased from 75% to 93%. The dimensions of the horn for which Table 1 provides the modal content is defined in more detail, by way of example, in FIG. 2, in which the dimensions are given in units of one wavelength. For example, the exit aperture of the last flare section 12*d* is 2.74 wavelengths in diameter. The principle of the invention can also be applied for rectangular horns to achieve high aperture efficiency.

Figure 3:
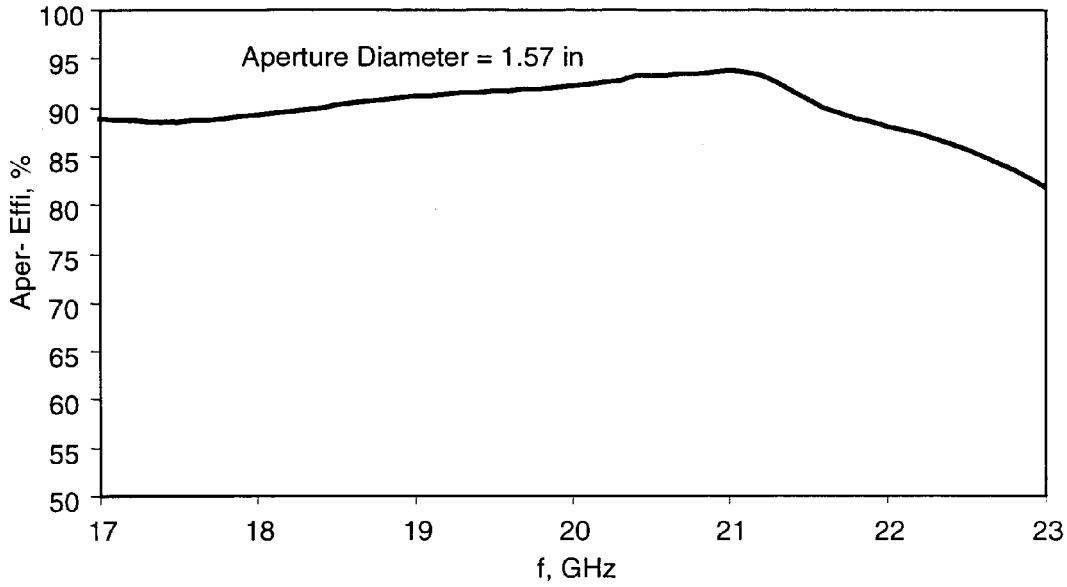
FIG. 3 is graph showing the aperture efficiency of the antenna horn of the invention over a range of frequencies from 17 to 23 GHz (gigahertz).

FIG. 3 is a graph plotting the computed aperture efficiency versus frequency. A horn with four flare sections was fabricated and tested at Ka-band frequency to verify the design concept. Table 2 shows computed and measured gain of the horn at Ka-band frequencies.

TABLE 2

| Frequency | Boresight Directivity dBi (decibels isotropic) | | EOC Directive Gain (dBi) | |
|---|---|---|---|---|
| (GHz) | Simulation | Measured | Simulation | Measured |
| 20.20 | 18.09 | 18.10 | 16.58 | 16.58 |
| 20.45 | 18.23 | 18.26 | 16.68 | 16.71 |
| 20.70 | 18.32 | 18.33 | 16.72 | 16.76 |
| 20.95 | 18.36 | 18.42 | 16.73 | 16.76 |
| 21.20 | 18.43 | 18.50 | 16.73 | 16.77 |
| f-average | 18.29 | 18.32 | 16.69 | 16.72 |

The measured data, as shown in Table 2, compares well with the computed data. The gain at 20.7 GHz corresponds to 91% aperture efficiency, which is significantly higher (about 10% to 15%) than that of a conventional pyramidal or conical horn of same aperture size and length.

Figure 4:
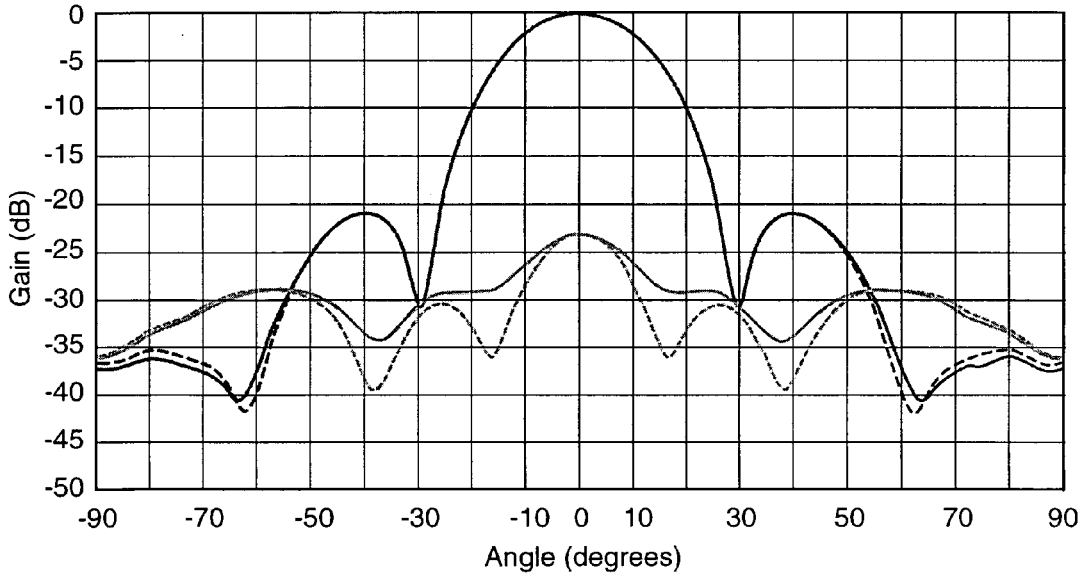
FIG. 4 is a graph showing simulated co-polarization and cross-polarization patterns of the antenna horn of FIG. 1 including a polarizer.
Figure 5:
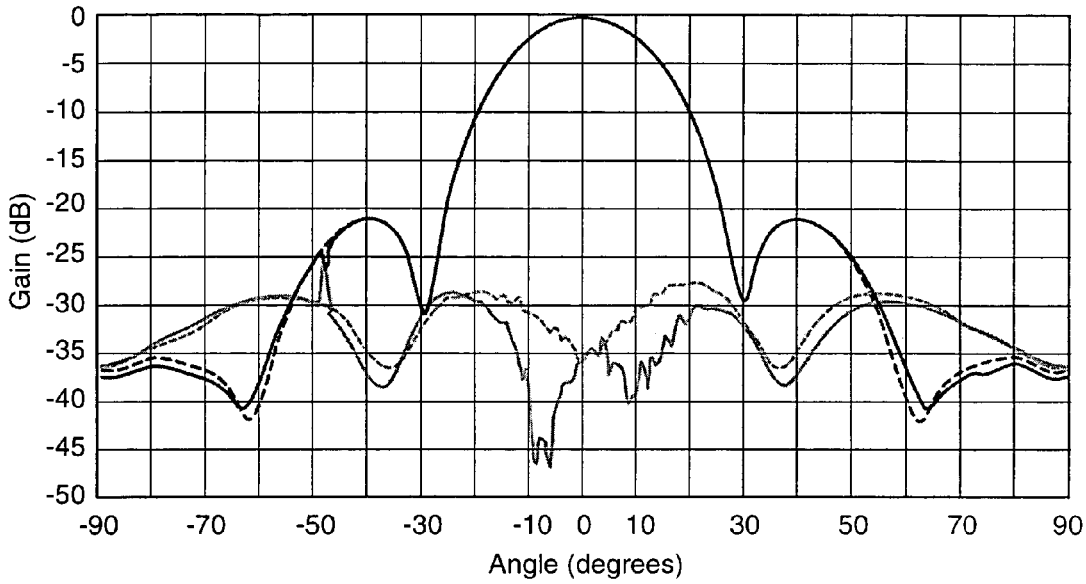
FIG. 5 is a graph similar to FIG. 4, but using measured instead of simulated data.
Figure 6:
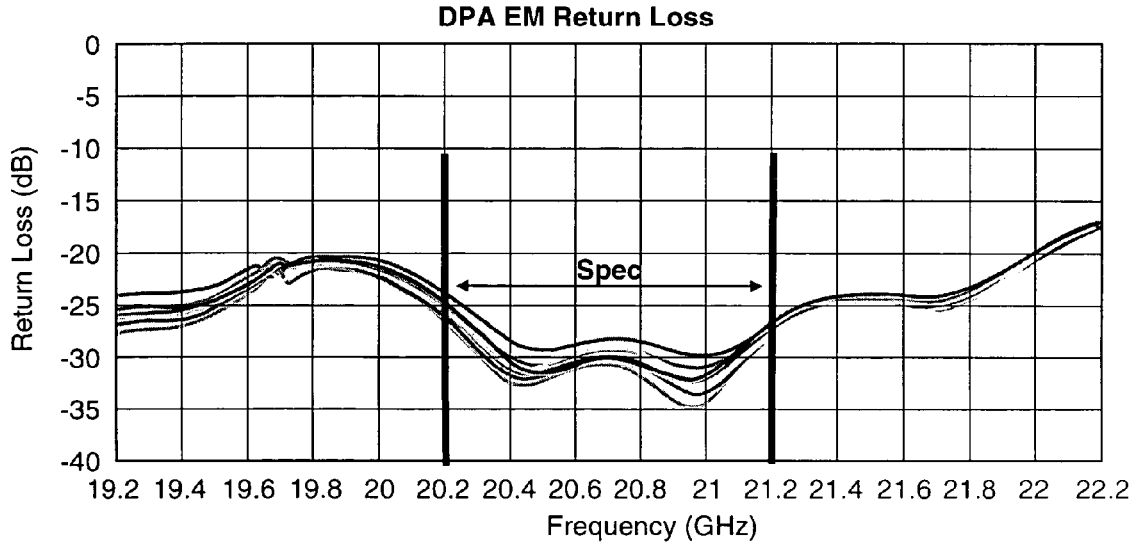
FIG. 6 is a graph showing measured return loss of the antenna horn of FIG. 1.

FIG. 4 shows computed co-polarization and cross-polarization patterns of a circular 4-flared horn at 20.7 GHz frequency. FIG. 5 shows the measured radiation patterns of the 4-flared horn of the present invention. The computed pattern agrees well with the measured pattern. The measured gain is 18.33 dBi, which corresponds to 91% aperture efficiency. The side lobe level is about 20 dB, which is consistent with a radiation pattern that has high aperture efficiency. FIG. 6 shows the measured return loss of the 4-flared horn with polarizers. The return loss is a measure of how much energy is reflected back into the horn at the horn aperture, in the transmit mode. The return loss is better than −25 dB within the frequency band of interest.

It will be noted that the second flare section 12*b* is not, strictly speaking, flared at all, but is cylindrical. In the context of this invention, the terms "flare" and "flared" are intended to encompass not only sections that are flared outwardly toward the aperture or the horn, but also sections that are flared inwardly and sections that are not tapered at all, such as the section 12*b*. Basically, the non-tapered section 12*b* serves the function or allowing selected unwanted modes to attenuate before they reach the horn aperture. In effect, the non-tapered section functions as a mode filter and the sections function in concert to produce a desired combination of modes with desired amplitudes and phases at the horn aperture.

It will be appreciated from the foregoing that the present invention represents a significant advance in the field of antenna horn design. In particular, the invention provides high horn aperture efficiency and, therefore, a high antenna gain, by use of multiple flared sections selected to provide an ideal combination of electromagnetic wave modes at the aperture. It will also be appreciated that, although a specific embodiment of the invention has been described in detail for purposes of illustration, various modifications may be made without departing from the spirit and scope of the invention. Accordingly, the invention should not be limited except as by the appended claims.

The invention claimed is:

1. An antenna horn with enhanced aperture efficiency, the antenna horn comprising:

a first outward flare section, a second cylindrical flare section, a third outward flare section, and a fourth outward flare section;

wherein the first outward flare section is adapted to be coupled to a waveguide and the fourth outward flare section has an aperture through which electromagnetic energy is coupled to or from space;

wherein the slopes and lengths of the first outward flare section, the second cylindrical flare section, the third outward flare section, and the fourth outward flare section are selected to enhance desirable electromagnetic modes at the aperture, thereby enhancing the aperture efficiency and antenna gain;

wherein the first outward flare section is coupled to the second cylindrical flare section without a step discontinuity;

wherein the second cylindrical flare section is coupled to the third outward flare section without a step discontinuity;

wherein the third outward flare section is coupled to the fourth outward flare section without a step discontinuity;

wherein the desirable electromagnetic modes are TE modes and the first outward flare section, the second cylindrical flare section, the third outward flare section, and the fourth outward flare section are selected to enhance the TE modes and suppress any TM modes at the aperture.

2. An antenna horn as defined in claim 1, wherein the antenna horn further comprises an input section coupled between the waveguide and the first outward flare section.

3. An antenna horn of claim 1, wherein the antenna horn emits TE mode electromagnetic waves at the horn's aperture.

4. The antenna horn of claim 1 wherein the antenna horn emits TM mode waves at the horn's aperture.

5. An antenna horn as defined in claim 1, wherein the horn has slope discontinuities between adjacent flared horn sections, but no step discontinuities.

6. The apparatus of claim 1, wherein the third outward flare section comprises a third flare angle;

wherein the fourth outward flare section comprises a fourth flare angle;

wherein the third flare angle is greater than the fourth flare angle.

7. The apparatus of claim 1, wherein the antenna horn has a total axial length no greater than twice the width of the aperture.

8. The apparatus of claim 1, wherein the electromagnetic energy comprises a wavelength;

wherein the first outward flare section comprises an axial length of approximately 0.9 times the wavelength;

wherein the second cylindrical flare section comprises an axial length of approximately 0.81 times the wavelength;

wherein the third outward flare section comprises an axial length of approximately 1.126 times the wavelength;

wherein the fourth outward flare section comprises an axial length of approximately 1.274 times the wavelength.

9. The apparatus of claim 8, wherein the first outward flare section comprises an entry aperture diameter of approximately 0.99 times the wavelength;

wherein the second cylindrical flare section comprises an aperture diameter of approximately 1.754 times the wavelength;

wherein the third outward flare section comprises an exit aperture diameter of approximately 2.527 times the wavelength;

wherein the fourth outward flare section comprises an exit aperture diameter of approximately 2.754 times the wavelength.

10. The apparatus of claim 9, wherein the wavelength comprises a microwave wavelength.

11. The apparatus of claim 9, wherein the electromagnetic energy comprises a frequency approximately between 17 and 23 gigahertz.

12. The apparatus of claim 10, wherein the electromagnetic energy comprises a Ka-band frequency.

13. An apparatus, comprising:

an antenna horn for sending and receiving electromagnetic energy;

wherein the antenna horn comprises a first outward flare section, a second cylindrical flare section, a third outward flare section, and a fourth outward flare section;

wherein the first outward flare section is adapted to be coupled to a waveguide and the fourth outward flare section has an aperture through which the electromagnetic energy is coupled to or from space;

wherein the first outward flare section comprises a flare angle of approximately 23.0 degrees;

wherein the second cylindrical flare section comprises a flare angle of approximately 0.0 degrees;

wherein the third outward flare section comprises a flare angle of approximately 18.94 degrees;

wherein the fourth outward flare section comprises a flare angle of approximately 5.09 degrees.

14. The apparatus of claim 13, wherein the electromagnetic energy comprises a microwave wavelength.

15. The apparatus of claim 13, wherein the electromagnetic energy comprises a frequency approximately between 17 and 23 gigahertz.

16. The apparatus of claim 13, wherein the antenna horn comprises an input section coupled between the waveguide and the first outward flare section.

17. The apparatus of claim 13, wherein the horn has slope discontinuities between adjacent flared horn sections, but no step discontinuities.

18. The apparatus of claim 13, wherein the electromagnetic energy comprises a Ka-band frequency.

19. An apparatus, comprising:

an antenna horn for sending and receiving electromagnetic energy;

wherein the antenna horn comprises a first flare section, a second flare section, a third flare section, and a fourth flare section that are coupled in succession without any step discontinuities;

wherein the first flare section is adapted to be coupled to a waveguide and the fourth flare section has an aperture through which the electromagnetic energy is coupled to or from space;

wherein the first flare section comprises a first flare angle that is positive;

wherein the second flare section comprises a second flare angle that is less than the first flare angle;

wherein the third flare section comprises a third flare angle that is greater than the second flare angle;

wherein the fourth flare section comprises a fourth flare angle that is less than the third flare angle.

20. The apparatus of claim 19, wherein the second flare angle is approximately equal to 0.0 degrees;

wherein the fourth flare angle is greater than 0.0 degrees.

* * * * *